United States Patent [19]

Buckley et al.

[11] Patent Number: 5,069,130

[45] Date of Patent: Dec. 3, 1991

[54] PROPELLANT IGNITER

[75] Inventors: Dieter Buckley, Nurmberg; Erhard Munster, Altdorf; Wolfgang Schwarz, Nurmberg, all of Fed. Rep. of Germany

[73] Assignee: Diehl GmbH & Co., Nurmberg, Fed. Rep. of Germany

[21] Appl. No.: 608,246

[22] Filed: Nov. 2, 1990

[30] Foreign Application Priority Data

Nov. 16, 1989 [DE] Fed. Rep. of Germany ..... 3938123

[51] Int. Cl.[5] ..... F42B 5/02

[52] U.S. Cl. ..... 102/202; 60/39.823

[58] Field of Search ..... 102/202, 287, 291, 430, 102/469, 470; 60/39.823, 256

[56] References Cited

U.S. PATENT DOCUMENTS

| | | | |
|---|---|---|---|
| 1,367,464 | 2/1921 | Cook | 102/430 |
| 2,592,623 | 4/1952 | Turnbull | 102/430 |
| 3,101,590 | 8/1963 | Hagerty | 60/256 |
| 3,977,330 | 8/1976 | Held | 102/499 |
| 4,149,465 | 4/1979 | Verkozen | 102/470 |
| 4,168,191 | 9/1979 | Berzinger | 149/19.91 |

FOREIGN PATENT DOCUMENTS

| | | | |
|---|---|---|---|
| 79982 | 10/1955 | Denmark | 102/430 |
| 31551 | 3/1885 | Fed. Rep. of Germany . | |
| 1428665 | 12/1968 | Fed. Rep. of Germany . | |
| 3701145 | 8/1987 | Fed. Rep. of Germany | 102/470 |
| 3740986 | 6/1988 | Fed. Rep. of Germany . | |

*Primary Examiner*—Charles T. Jordan
*Assistant Examiner*—Stephen Johnson
*Attorney, Agent, or Firm*—Scully, Scott, Murphy and Presser

[57] ABSTRACT

A propellant igniter for a cartridge including an ignition tube which extends into the propellant; and with a booster charge arranged at one end of the ignition tube having a pyrotechnic igniting composition therein, which leaves the presence of a central passageway. The igniting composition or charge is formed from a tubular, hardened or set layer constituted of a pyrotechnic lacquer or varnish. Preferably, the pyrotechnic layer is cast into the ignition tube while in a pourable state, and then hardened or cured within the tube. The pyrotechnic layer can also be applied onto a combustible conduit tube for gas fumes, hardened thereon and then inserted into the ignition tube.

7 Claims, 1 Drawing Sheet

PROPELLANT IGNITER

BACKGROUND OF THE INVENTION

1. Field of the Invention

The present invention relates to a propellant igniter for a cartridge including an ignition tube which extends into the propellant; and with a booster charge arranged at one end of the ignition tube having a pyrotechnic igniting composition therein, which leaves the presence of a central passageway.

2. Discussion of the Prior Art

A propellant igniter of that type is described in the disclosure of German Laid-Open Patent Appln. 37 40 986 Al. In accordance therewith, the igniting composition is formed from ring-shaped tablets or from a poured charge. In order to ensure the presence of a uniform ignition for the propellant, provision is made for a regulating or control sleeve which, as a consequence of the gas pressure which is generated during the ignition within the central passageway, displaces itself from a closing position into an opened position in which it frees the exhaust or blowout apertures of the ignition tube This construction appears to be complicated in nature in as much as there must be afforded the displaceability of the regulating or control sleeve within the propellant. Furthermore, it is inexpedient when employing the tablets, that they must be individually pressed through the intermediary of a suitable worktool and then so experimented with so as to ensure they will not break apart or crumble even under environmental tests which are normally conducted for propellant igniters

SUMMARY OF THE INVENTION

Accordingly, an object of the present invention is to propose the provision of a propellant igniter of the above-mentioned type through the intermediary of which there is achieved a uniform combusting or burning behavior for the propellent powder at a simplified construction thereof.

Inventively, the foregoing object is attained for a propellant igniter of the above-mentioned type in that the igniting composition or charge is formed from a tubular, hardened or set layer constituted of a pyrotechnic lacquer or varnish.

Preferably, the pyrotechnic layer is cast into the ignition tube while in a pourable state, and then hardened or cured within the tube. However, the pyrotechnic layer can also be applied onto a combustible conduit tube for gas clouds or fumes, hardened thereon and then inserted into the ignition tube.

The pyrotechnic lacquer is produced, for example, from a nitrocelulose (NC)-lacquer or varnish and black powder and/or boron/potassium nitrate compositions, or igniting mixtures containing zircon and/or titanium as reduction media and nitrates or metal oxides as oxidation media. The viscosity of the pyrotechnic lacquer is pourably adjusted in such a manner as to permit itself to be dispersed into the tubular layer. Subsequent to drying, the pyrotechnic layer is solid. The need for pressing tools and/or experimentation efforts is eliminated The pyrotechnic layer leaves the central passageway open. Through the foregoing there is afforded that the pyrotechnic layer will be practically concurrently ignited along its entire length within the ignition tube by means of the gas clouds generated from the booster charge. Obtained therefrom is a uniform burning or combusting behavior for the propellant powder, inasmuch as the flame front which develops within the propellant will not overtake the burning down of the pyrotechnic layer.

Further control possibilities over the flame front in the propellant are obtained through differing configurations for the exhaust or blowout openings of the ignition tube and/or the configuration of a conduit tube for gas clouds or fumes which is arranged in the central passageway.

Pursuant to a preferred embodiment of the invention, a closure piece is located at the end of the ignition tube which is remote from the booster charge, whereby the closure piece will open at the presence of a specified internal pressure reigning in the central passageway. Upon the opening of the closure piece there is produced a flow of the hot gas clouds or fumes from the booster charge along the pyrotechnic layer. This enhances the erosive burning or combustion of the layer.

BRIEF DESCRIPTION OF THE DRAWINGS

Further advantageous embodiments of the invention may now be more readily ascertained from the following detailed description of exemplary embodiments thereof, taken in conjunction with the accompanying drawings; in which.

DETAILED DESCRIPTION

Figure 1:
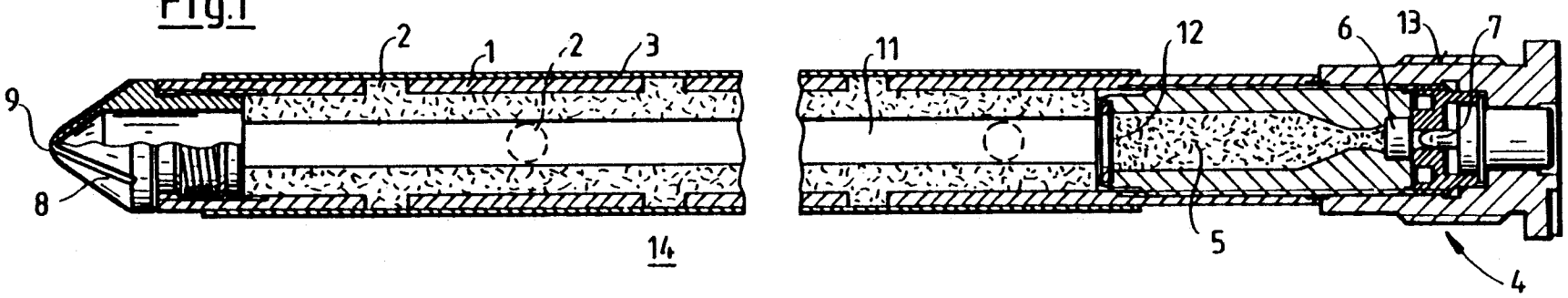
FIG. 1 illustrates a longitudinal sectional view through an inventive propellant igniter.

A propellant igniter possesses a metallic ignition tube 1. This tube is provided about its circumference and along its length with a plurality of exhaust or blowout apertures 2. The blowout apertures 2 are closed off through the intermediary of a combustible cover foil 3.

Into one end of the ignition tube 1 there is threaded an igniting device 4. Arranged in this device is a booster charge 5, a primer cap 6 and a firing pin 7. The booster charge 5, for example, consists of black powder or pressed NC-tablets, or any other rapidly burning propellant powder.

At the end of the ignition tube 1 which is remote from the igniting device 4, the tube is closed off by a closure piece 8. This closure piece forms a hood which is equipped with breaking or rupture locations 9.

The ignition tube 1 is clad or covered along the entire length thereof, extending between the closure piece 8 and the booster charge 5, with a tubular pyrotechnic layer 10. The layer 10 also fills out the exhaust or blowout apertures 2. The layer 10 leaves a central passageway 11 free within the interior of the ignition tube 1. With respect to the central passageway, the booster charge 5 is covered off by means of a rupturable disc 12.

When the above-described propellant igniter is screwed into a suitable cartridge or shell (not shown) by means of an external screwthread 13, the ignition tube 1 then protrudes into the propellent composition thereof, which is located in the surroundings 14 of the ignition tube 1.

The pyrotechnic layer 10 is produced from a pyrotechnic lacquer or varnish which is filled in a pourable consistency into the ignition tube 1 which is provided with the cover foil 3, and dispersed within the tube. The pyrotechnic lacquer contains the usual compounds of igniting compositions or charges, admixed with NC-lacquer. Upon the drying of the pyrotechnic lacquer, the pyrotechnic layer 10 is finished. Thereafter, the igniting device 4 and the closure piece 8 are screwed into the ignition tube 1.

The manner of functioning of the above-described propellant igniter is essentially as follows:

Through the broaching action of the primer cap 6, the latter ignites the booster charge 5. The resultingly generated hot gas clouds or fumes from the booster charge 5 break through the disc 12 and expand uniformly within the central passageway 11. At the presence of a certain internal pressure in the central passageway 11, the closure piece 8 breaks at the breaking or rupture locations 9. The foregoing causes a flow of the hot gas clouds or fumes along the surface of the pyrotechnic layer 10. The pyrotechnic layer 10 is almost uniformly ignited along its entire length by the action of the gas clouds or fumes. As a result thereof, the propellant is practically simultaneously ignited in the surroundings 14 at all exhaust or blowout apertures 2. Formed thereby in the propellant is a uniform flame front, so that the igniting action of the propellant igniter is reproducible.

Figure 2:
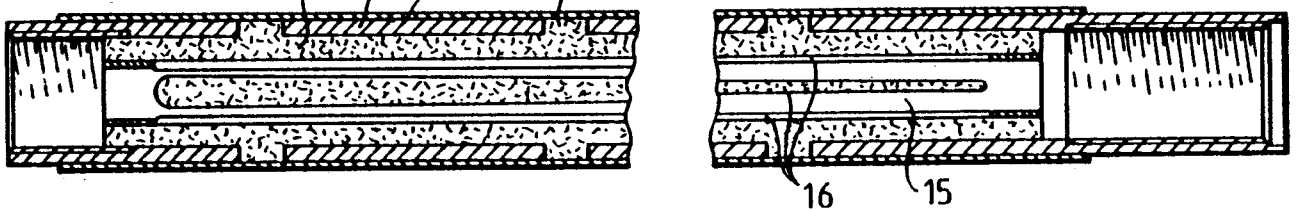
FIG. 2 illustrates a longitudinal sectional view through a further embodiment of a portion of a propellant igniter.

In the embodiment pursuant to FIG. 2, a gas cloud or fume conduit tube 15 is arranged within the pyrotechnic layer 10. This tube possesses a plurality of longitudinal or elongated slots 16. The width of each of the elongated slots 16 increases towards the closure piece 8. In view thereof, the pyrotechnic layer 10 is initially less intensively ignited by the gas clouds or fumes from the booster charge 5 in the region proximate the igniting device 5 then in the region which is more distant from the igniting device 4. Correspondingly, influenced is the ignition of the propellant. The gas cloud conduit tube 15 can also be configured to be nozzle-shaped or conical in order to be able to achieve in a controlled manner a starting location for the ignition of the pyrotechnic layer 10.

Figure 3:
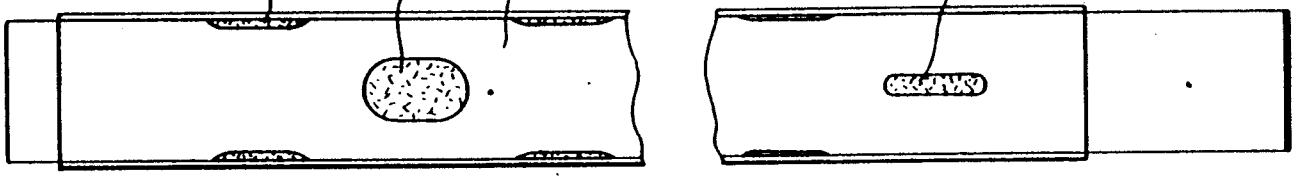
FIG. 3 illustrates, partly in section, an embodiment of the ignition tube for the propellant igniter.

In the exemplary embodiment pursuant to FIG. 3, exhaust or blowout apertures 2 of differing crosssections are provided on the ignition tube 1. The blowout apertures 2 which are close to the igniting device 4 are smaller in size than the remaining blowout apertures 2. Through the size of the various blowout apertures 2, there is controlled the timing relationship in the burning or combusting of the propellant powder. Moreover, by means of the dimensioning of the blowout apertures 2, there can be influenced the extending through or passage of the burning of the pyrotechnic layer 10 into the propellant; in essence, influencing the surface and the depth of the portion of the propellant which is directly ignited through the blowout apertures 2 from the pyrotechnic layer 10. The blowout apertures 2 can be configured to be either conical, slit-shaped or possessing differently sized diameters.

What is claimed is:

1. Propellant igniter for a cartridge; including an ignition tub extending into a propellant for said cartridge; a booster charge being located at one end of said ignition but and having a pyrotechnic ignition charge therein leaving the presence of a central passageway, aid ignition charge being formed from a tubular, hardened layer constituted from a pyrotechnic lacquer; a gas cloud conduit tube being arranged coaxially within the ignition tube, and slots in said gas cloud conduit, the width of aid slots increasing in a direction toward the end of said conduit tube which is distance from the booster charge.

2. Propellant igniter as claimed in claim 1, wherein said ignition tube includes blowout apertures each covered on the exterior thereof, said pyrotechnic lacquer filling said blowout apertures.

3. Propellant igniter as claimed in claim 2, wherein the blowout apertures of the ignition tube are of varied specified sizes and configurations for controlling the ignition of said propellant.

4. Propellant igniter as claimed inc claim 1, wherein said pyrotechnic lacquer is applied on said gas could conduit tube.

5. Propellant igniter as claimed in claim 1, wherein said pyrotechnic lacquer is constituted from a material consisting of an igniting composition admixed with a nitrocelulose lacquer.

6. Propellant igniter as claimed in claim 1, wherein closure means is located on the end of said ignition tube which is distance from the booster charge, said closure means being openable in the presence of a specified internal pressure reigning in the central passageway.

7. Prollant igniter as claimed in claim 6, wherein said closure means incorporates breaking locations.

* * * * *

UNITED STATES PATENT AND TRADEMARK OFFICE

CERTIFICATE OF CORRECTION

PATENT NO. : 5,069,130

DATED : December 3, 1991

INVENTOR(S) : Dieter Buckley, et al.

It is certified that error appears in the above-identified patent and that said Letters Patent is hereby corrected as shown below:

Column 4, line 14, Claim 1: "tub" should read --tube--.

Column 4, line 16, Claim 1: "but" should read --tube--.

Column 4, line 18, Claim 1: "aid" should read --said--.

Column 4, line 22, Claim 1: "aid" should read --said--.

Column 4, line 22, Claim 1: "toward" should read --towards--.

Column 4, line 23, Claim 1: "distance" should read --distant--.

Column 4, line 33, Claim 4: "inc" should read --in--.

UNITED STATES PATENT AND TRADEMARK OFFICE

CERTIFICATE OF CORRECTION

PATENT NO. : 5,069,130

DATED : December 3, 1991

INVENTOR(S) : Dieter Buckley, et al.

It is certified that error appears in the above-identified patent and that said Letters Patent is hereby corrected as shown below:

Column 4, line 34, Claim 4: "could" should read --cloud--.

Column 4, line 39, Claim 5: "nitrocellulose" should read --nitrocellulose--.

Column 4, line 43, Claim 6: "distance" should read --distant--.

Column 4, line 45, Claim 7: "prollant" should read --propellant--.

Signed and Sealed this

First Day of June, 1993

*Attest:*

Michael K. Kirk

MICHAEL K. KIRK

*Attesting Officer*

*Acting Commissioner of Patents and Trademarks*